United States Patent [19]

Berthier et al.

[11] 4,298,227

[45] Nov. 3, 1981

[54] FOLDING CHAIR

[76] Inventors: Marc A. Berthier, 141 Bd. Saint-Michel, 75005 Paris; Alain Y. Chauvel, 49 rue des Rigoles, 75020 Paris, both of France

[21] Appl. No.: 934,065

[22] Filed: Aug. 16, 1978

[51] Int. Cl.[3] ..... A47C 4/00

[52] U.S. Cl. ..... 297/58

[58] Field of Search ..... 297/55, 58, 50, 51, 297/52, 63, 54, 56, 77, 59, 60

[56] References Cited

U.S. PATENT DOCUMENTS

| | | | |
|---|---|---|---|
| 1,948,216 | 2/1934 | Gillette | 297/58 |
| 2,509,107 | 5/1950 | O'Connor | 297/58 |
| 4,123,101 | 10/1978 | Minsker | 297/58 |

FOREIGN PATENT DOCUMENTS

| | | | |
|---|---|---|---|
| 515197 | 11/1952 | Belgium | 297/58 |
| 2006914 | 9/1969 | Fed. Rep. of Germany | 297/55 |
| 669494 | 12/1929 | France | 297/58 |

*Primary Examiner*—Roy D. Frazier
*Assistant Examiner*—Peter A. Aschenbrenner
*Attorney, Agent, or Firm*—Holman & Stern

[57] ABSTRACT

The invention relates to the wood or metal furniture industry. It relates to a folding chair including a front frame, with a U-shaped lower portion and a U-shaped rear frame, forming together, the leg assembly of the chair, and a seat tray pivoted on the front frame and cooperating with the rear frame, characterized by pivoting means of the rear frame, on the one hand, and of the seat tray, on the other hand, on the front frame, so that in the folded position of the chair, the rear frame and the seat are both situated in the same plane, parallel to that of the front frame. Useful for supplementary seating.

6 Claims, 6 Drawing Figures

FOLDING CHAIR

BRIEF SUMMARY OF THE INVENTION

The present invention relates to the wood or metal furniture industry and more particularly to folding chairs.

Numerous folding chairs are already known whose major drawback is that they comprise many structural and pivoting parts, which complicates manufacturing supplies as well as their assembly and consequently makes the final product more expensive. It is a particular object of the present invention to overcome the aforementioned drawbacks of known chairs.

To this end the invention provides a folding chair comprising a front frame, a lower U-shaped portion and a rear U-shaped portion, forming together the leg assembly of the chair, and a seat tray pivoted on the front frame and cooperating with the rear frame, characterized by pivoting means for the rear frame on the one hand and for the seat tray on the other hand, on the front frame, such that in the folded position of the chair, the rear frame and the seat are both situated in the same plane, parallel to that of the front frame.

According to a feature of the invention, the frames of the chair (including that of the seat) are of wood and all of the same thickness. This feature enables notably the planing-rubbing down with a single adjustment of the machine and this after the assembly of the frames (from only two sections of wood) and drying.

In the same way, the pivoting of the frame to one another is effected by means of only two types of parts, one of these parts ensuring both:

the assembly and the reinforcement of the seat frame on the front frame and the rear frame.

the offset pivot (which permits the folding of the chair within only two, entirely parallel, thickness).

guidance (usual) in the groove of the rear frame.

According to another feature of the invention, the front and rear frames as well as the seat frame are formed from steel tubes of the same section.

The frames of the chair according to the invention are advantageously constituted by five tubular U-shaped members bent around the same radius. The assembly of the frames can hence be carried out after painting or chrome plating of the elements. The back-rest and seat are positioned during said assembly in the grooves (built-in or machined) of the frames.

The assembly of the frames is advantageously carried out by cast metal parts, force-fitted into the ends of the coupled U-shaped elements.

It will be noted also that both the wooden chair and the metal chair are constructed from structural and pivoting parts which are few in number. This feature enables a considerable reduction in investment in the stocking of parts as well as their cost by standardizing manufacture, and greatly facilitates the assembly of the chairs.

BRIEF DESCRIPTION OF THE SEVERAL VIEWS OF THE DRAWINGS

The invention will be better understood on reading the following description and on examining the accompanying drawings which show, by way of non-limiting example, two emodiments of a chair according to the invention.

In the drawings.

DETAILED DESCRIPTION

Figure 1:
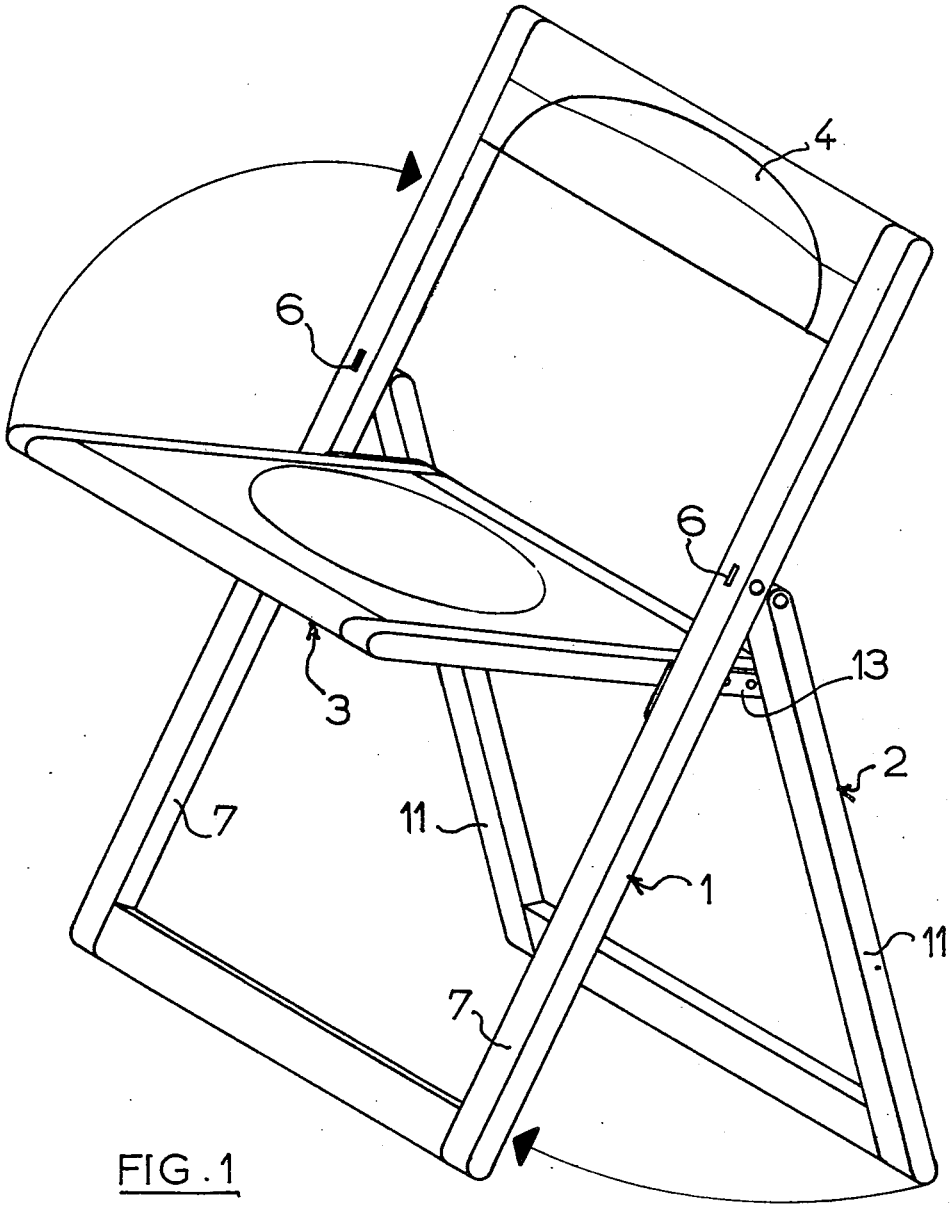
FIG. 1 is a perspective view of a first embodiment of a chair according to the invention.
Figure 2:
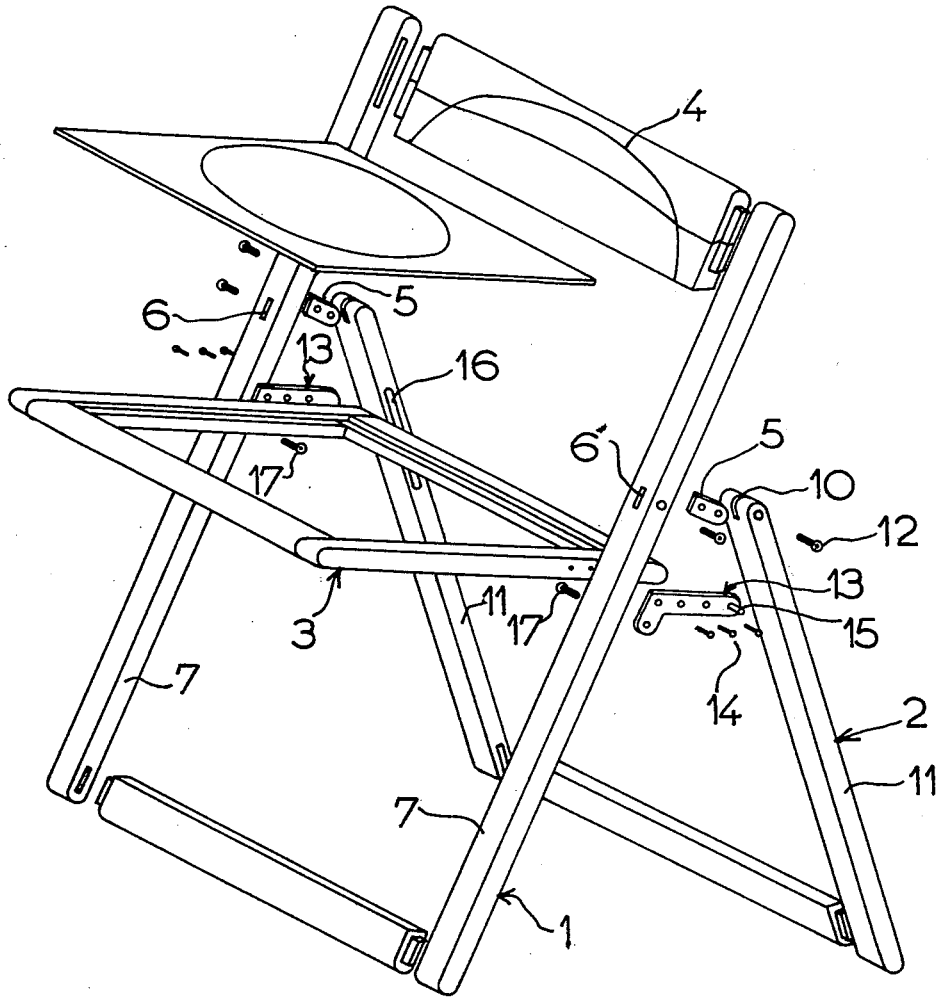
FIG. 2 is an exploded perspective view of the embodiment of the chair of FIG. 1.
Figure 3:
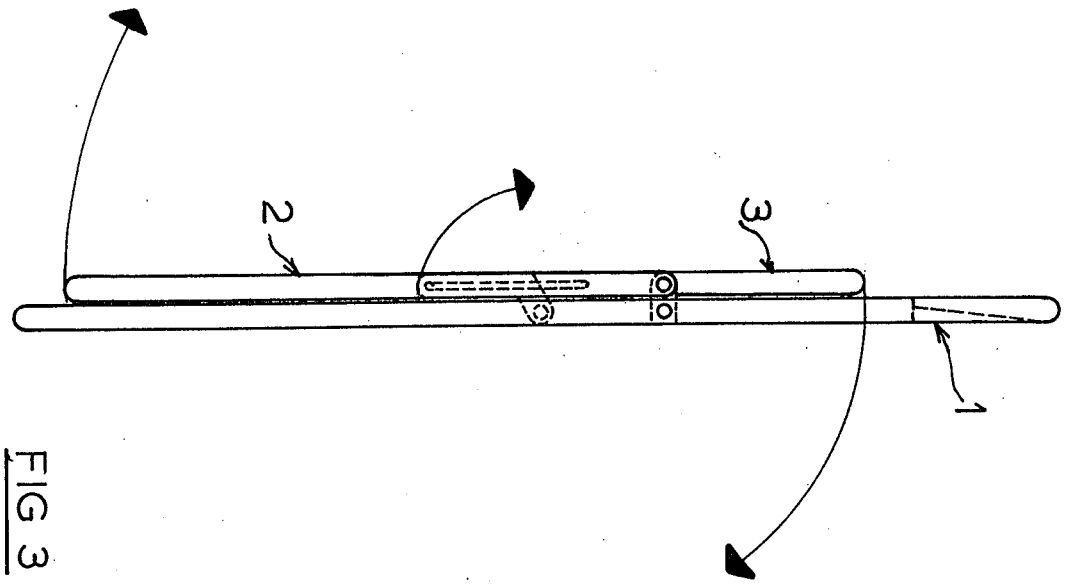
FIG. 3 is a left hand view of the chair of FIG. 1 in folded position.

The chair of FIGS. 1 to 3 is constructed of wood and comprises essentially: a rectangular front frame 1, a U-shaped rear frame 2, forming with the front frame 1 the leg assembly of the chair, and a seat frame 3 pivoted on the front frame 1 and cooperating with the rear frame 2.

The three frames are of the same thickness, absolutely flat, including the back-rest 4 of the front frame 2. They are constructed from only two wooden sections.

The assembly of the frames to one another is effected:

At the level of each articulation of the front frame 1 and of the rear frame 2, by two flat metal parts 5 each passing through a hole 6 formed in each "upright" 7 of the front frame. Each part 5 is held in its hole 6 by a screw 9 passing internally through the upright 7. The remaining portion of each part 5 extends into a cleft 10 of the corresponding upright 11 of the rear frame where it is traversed laterally by a pivot 12.

At the level of each articulation of the seat frame 3 on the front frame 1, by two L-shaped metal parts, 13, with unequal wings forming an obtuse angle.

The longest of the wings of each part 13 is fastened laterally to the seat frame 3 by several screws 14 and bears at its end a pin 15 extending into a longitudinal guide-groove 16 formed in the inner surface of each upright 11 of the rear frame 1. The shortest of the wings of each of said parts 13 is itself traversed by a pivot 17 extending into the corresponding upright 7 of the front frame 1.

Thus the articulated assembly of the three frames to one another is effected by means of two types only of metal parts.

Figure 4:
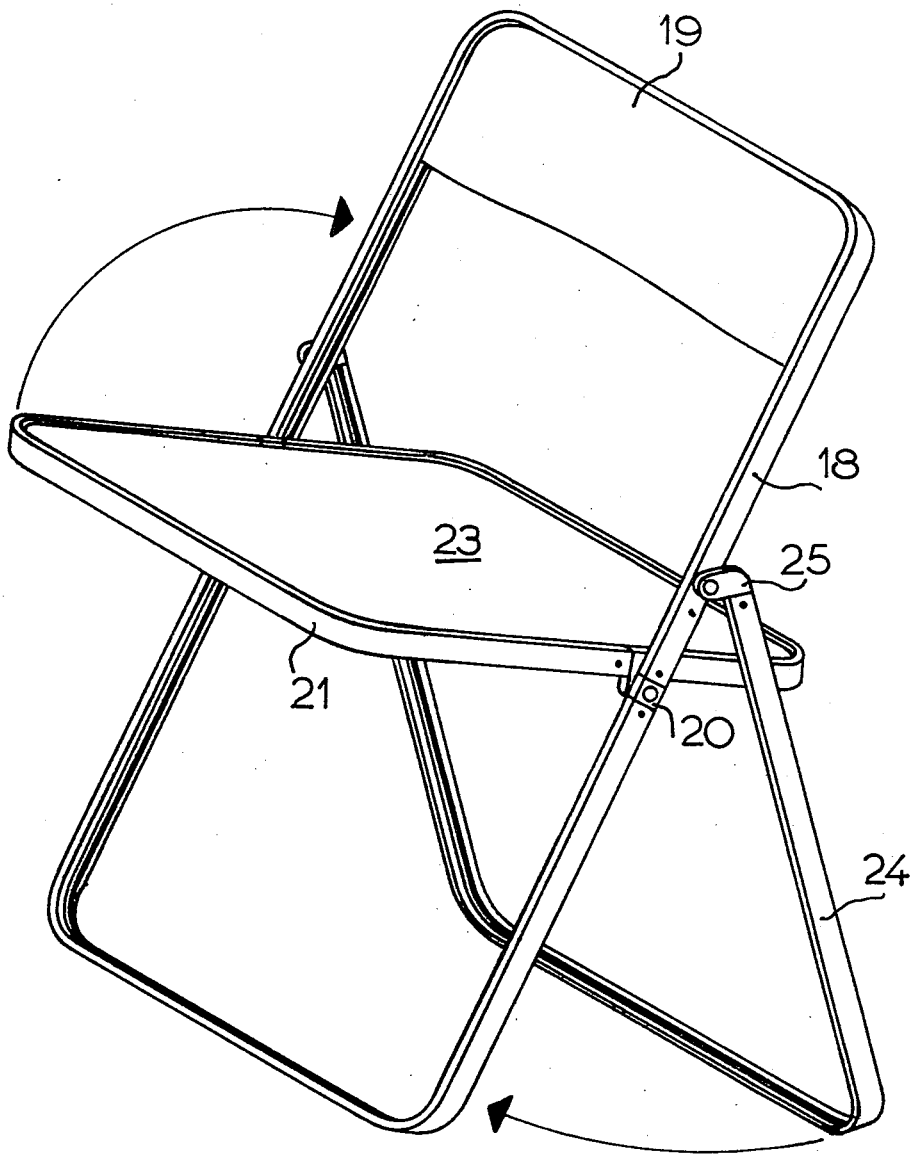
FIG. 4 is a perspective view of a second embodiment of a chair according to the invention.
Figure 5:
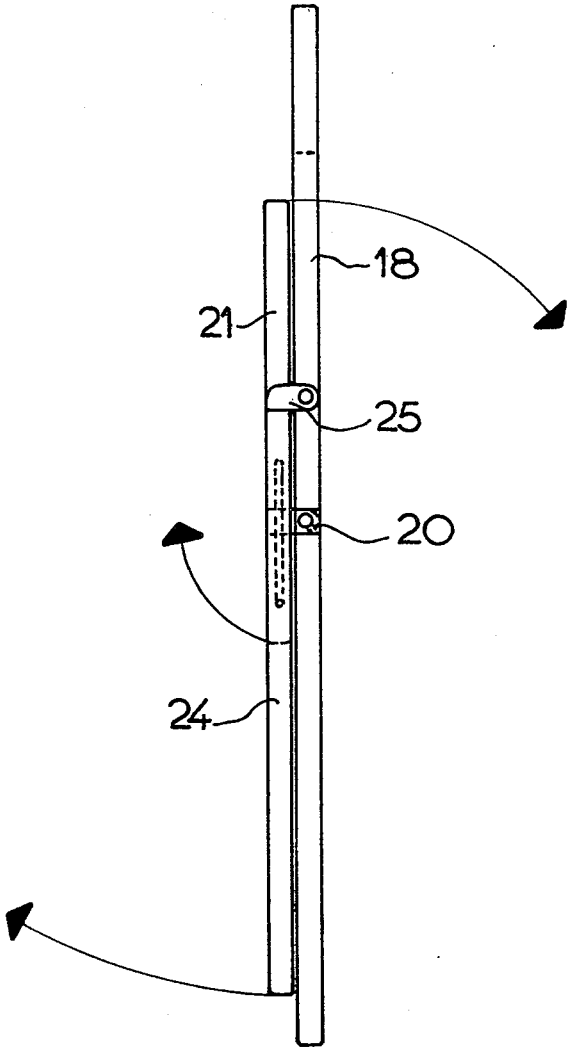
FIG. 5 is a left hand view of a chair of FIG. 4 in folded position.
Figure 6:
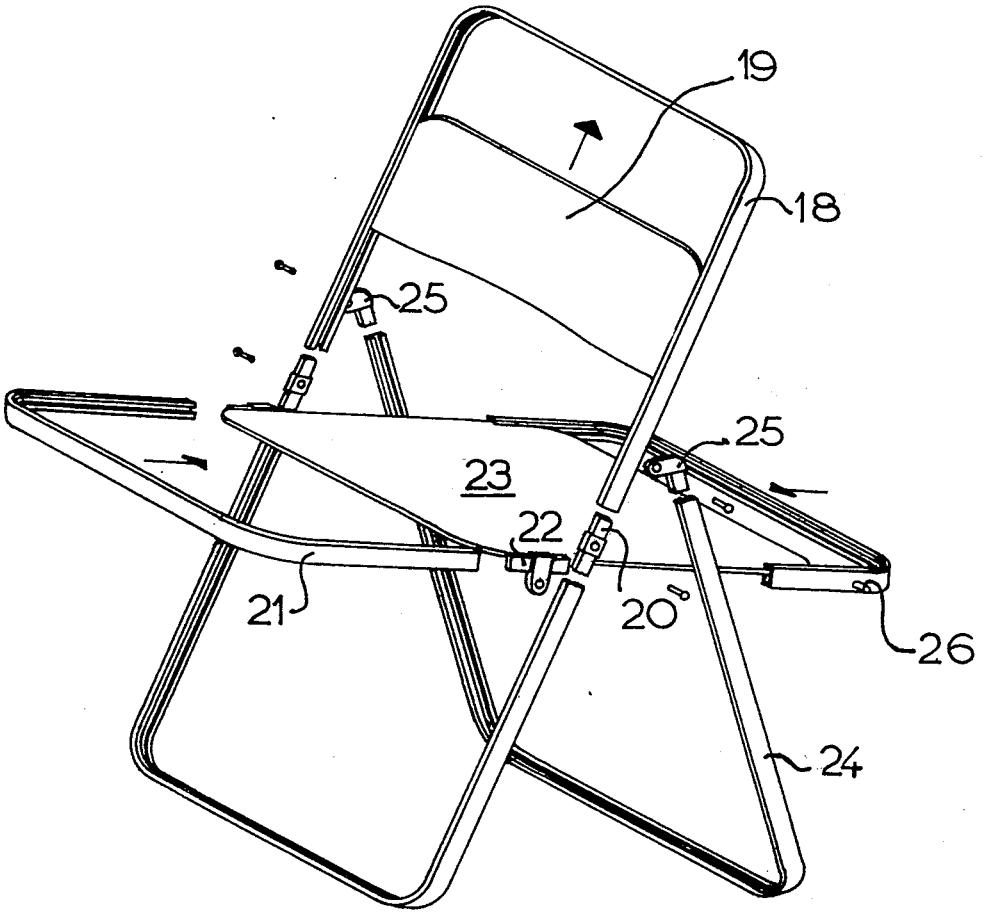
FIG. 6 is an exploded perspective view of the chair of FIG. 4

The embodiment of the chair of FIGS. 4 to 6 is formed of steel tubing of the same section, here open. It is composed of five U or half frames bent to the same radius.

The U-shaped elements constituting the front frame 18 of the chair are assembled after the back-rest 19 has been slid into the upper member. These two U-shaped elements are assembled by a molded metal part 20 bearing the pivot on which is hinged the seat 21.

The U-shaped elements constituting this seat 21 are assembled on each side by a second molded metal part after having imprisoned the seat proper 23. The molded part 22 is connected to the pivot of the part 20 below the level of the seat, in the open position of the chair.

Finally the last U-shaped element constituting the rear frame 24 is connected to the front frame by a third molded metal part 25 ensuring the pivoting of the rear frame 24 with respect to the front frame 18.

In this chair, the seat frame bears at the rear of its sides two pins 26 cooperating with slide-grooves to limit the movements of the seat frame 21 to a customary extent.

Like the wooden chair of FIGS. 1 to 3, the metal chair of FIGS. 4 to 6 folds into only two thicknesses (FIG. 5), the rear frame partly containing the seat frame.

According to the invention, the pivoting parts for wooden chairs can be notably of phosphated iron, whilst those for metal chairs can, themselves be notably molded of Zamac or of aluminum.

The seats and the back-rests of the metal chair can optionally be of plywood, wood, plastics, sheet metal, etc.

When chairs of "closed" tubes are constructed, it is possible either to limit the grooves to the only ones necessary, or indeed to slot the tubes over the whole length of the latter.

Of course, the invention is not limited in any way to the examples described and illustrated. It is capable of numerous modifications available to the technician skilled in the art according to the applications contemplated and without however departing from the scope of the invention.

We claim:

1. Folding chair, comprising a front frame with a U-shaped lower part and a U-shaped rear frame, forming together the leg assembly of the chair, a back rest at the upper end of the front frame and a seat tray articulated to the front frame and cooperating with the rear frame, articulation means for the rear frame and for the seat tray being provided on the front frame so that in the folded position of the chair the rear frame and the seat are both situated in the same plane parallel to and outside that of the front frame, said articulation means for the seat tray comprising connecting members each having at least two branches lying in the same plane, one branch being attached to the side of said seat tray and the other branch extending at an angle from said one branch and being pivotally connected to said front frame below said seat tray when in the open position, said articulation means for said rear frame comprising connecting members attached to said front frame above said seat connecting members each extending rearwardly and being pivotally connected to said rear frame, and means for slidably engaging said seat tray with said rear frame.

2. Chair according to claim 1, wherein said frames comprise wooden elements all having the same thickness.

3. Chair according to claim 1, wherein the frames are constituted by five tubular U-shaped elements bent to the same radius.

4. Chair according to claim 1, wherein the frames are of open metal tubes.

5. Chair according to claim 3 wherein in the seat frame is formed by two of the U-shaped elements, and said seat tray connecting members comprise molded metal parts which retain the ends of said two U-shaped elements in abutting relationship.

6. Folding chair, comprising a front frame, with a U-shaped lower part and a U-shaped rear frame, forming together the leg assembly of the chair and a seat tray articulated to the front frame and cooperating with the rear frame, articulation means for the rear frame on the one hand and for the seat tray on the other hand being provided on the front frame, so that in the folded position of the chair, the rear frame and the seat are both situated in the same plane, parallel to and outside that of the front frame, said articulation means for the seat tray comprising two L-shaped parts with unequal wings forming an obtuse angle, the small wing of each being connected by a pivot to the corresponding upright of the front frame, said pivot being situated below the plane of the seat in the open position of the chair and the large wing being fixed to the seat frame and bearing in addition a pin extending into a guide-groove of the corresponding upright of the rear frame.

* * * * *